US011727911B2

(12) United States Patent
Linke et al.

(10) Patent No.: US 11,727,911 B2
(45) Date of Patent: Aug. 15, 2023

(54) DEVICE FOR REDUCING AIRBORNE AND STRUCTURE-BORNE SOUND

(71) Applicant: Umfotec GmbH, Northeim (DE)

(72) Inventors: Berend Linke, Noerten-Hardenberg (DE); Ingo Krebs, Goslar (DE)

(73) Assignee: Umfotec GmbH, Northeim (DE)

( * ) Notice: Subject to any disclaimer, the term of this patent is extended or adjusted under 35 U.S.C. 154(b) by 303 days.

(21) Appl. No.: 17/143,217

(22) Filed: Jan. 7, 2021

(65) Prior Publication Data

US 2021/0207508 A1 Jul. 8, 2021

(30) Foreign Application Priority Data

Jan. 7, 2020 (DE) ..... 10 2020 100 162.2

(51) Int. Cl.
*G10K 11/172* (2006.01)
*G10K 11/162* (2006.01)

(52) U.S. Cl.
CPC ..... *G10K 11/172* (2013.01); *G10K 11/162* (2013.01)

(58) Field of Classification Search
CPC .... G10K 11/162; G10K 11/172; F01N 1/026; F01N 1/02; F01N 1/04; F01N 2470/02; F02M 35/1255; F02M 35/1266; F02M 35/1272
USPC ..... 181/221
See application file for complete search history.

(56) References Cited

U.S. PATENT DOCUMENTS 2,043,731 A * 6/1936 Bourne ..... F01N 1/006 89/14.4
2,311,676 A * 2/1943 Hamilton ..... F01N 13/18 181/252
2,326,612 A * 8/1943 Bourne ..... F01N 1/04 181/252

(Continued)

FOREIGN PATENT DOCUMENTS

CH 550 964 6/1974
DE 100 58 479 5/2002

(Continued)

OTHER PUBLICATIONS

German Office Action dated Sep. 3, 2020.

*Primary Examiner* — Jeremy A Luks
(74) *Attorney, Agent, or Firm* — Gerald E. Hespos; Michael J. Porco

(57) ABSTRACT

A device for reducing airborne and structure-borne sound has a flow channel with a flow channel wall (22, 22', 22") and at least one resonator chamber (40, 40', 40") adjacent the flow channel wall (22, 22', 22"). The flow channel wall is formed by a sound absorber (30, 30', 30") at least in a part bordering the resonator chamber (40, 40', 40"). The sound absorber (30, 30', 30") is covered towards the resonator chamber (40, 40', 40") by an acoustically reflecting inner wall (42, 42', 42") of the resonator chamber with at least one wall aperture (44, 44', 44"). Openings (32, 32', 32") completely covers the wall aperture (44, 44', 44") of the inner wall (42, 42', 42") of the resonator chamber such that sound waves flowing through the flow channel must pass the sound absorber (30, 30', 30") to enter the resonator chamber (40, 40', 40").

15 Claims, 4 Drawing Sheets

(56) References Cited

U.S. PATENT DOCUMENTS

| | | | | | |
|---|---|---|---|---|---|
| 2,904,125 | A * | 9/1959 | Bourne | F16L 55/02727 | 181/248 |
| 3,791,483 | A | 2/1974 | Vasiljevic | | |
| 3,955,643 | A * | 5/1976 | Clark | F01N 1/006 | 181/248 |
| 4,109,754 | A * | 8/1978 | Purhonen | F24F 13/24 | 181/252 |
| 4,589,517 | A * | 5/1986 | Fukuda | F01N 1/006 | 181/258 |
| 5,350,888 | A * | 9/1994 | Sager, Jr. | F01N 1/24 | 181/252 |
| 5,783,780 | A * | 7/1998 | Watanabe | F02M 35/1261 | 181/252 |
| 8,256,569 | B1 * | 9/2012 | Huff | F01N 1/026 | 181/252 |
| 8,485,314 | B2 * | 7/2013 | Danner | F01N 13/16 | 181/246 |
| 9,376,946 | B1 * | 6/2016 | Eliers | F02M 35/1266 | |
| 2016/0169070 | A1 | 6/2016 | Hoerr et al. | | |
| 2017/0030610 | A1 * | 2/2017 | Schaake | G10K 11/172 | |

FOREIGN PATENT DOCUMENTS

| | | |
|---|---|---|
| DE | 10 2014 225 749 | 6/2016 |
| DE | 10 2018 201 829 | 8/2019 |
| EP | 3 594 585 | 6/2019 |
| WO | 2019/092038 | 5/2019 |

* cited by examiner

DEVICE FOR REDUCING AIRBORNE AND STRUCTURE-BORNE SOUND

BACKGROUND

Field of the Invention

The invention relates to a device for reducing airborne and structure-borne sound, comprising a flow channel with a flow channel wall and at least one resonator chamber adjacent to the flow channel wall, the flow channel wall being formed by a sound absorber at least in a part of the area bordering the resonator chamber, wherein the sound absorber is covered towards the resonator chamber by an acoustically reflecting inner wall of the resonator chamber with at least one wall aperture.

Related Art

Devices for reducing airborne and structure-borne sound are known from EP 3 594 585 A1.

Resonators that function according to the Helmholtz principle offer a conventional way of damping airborne and structure-borne sound. In such resonators, sound waves can pass through openings into a resonator chamber, where the interaction of the sound waves with the resonator chamber generates a counter-sound that reduces the pressure fluctuations of the sound waves flowing through. Classical resonator chambers dampen sound in a rather narrow-band frequency range. However, by using multiple resonator chambers with different volumes, sound dampening can be achieved across a broader band in the range of 700 to 3000 Hz.

One way of reducing airborne and structure-borne sound is to use sound absorbers. Sound absorbers have a porous or fibrous structure into which sound waves can penetrate, to be converted into heat by friction. The effectiveness of planar sound absorbers depends on the size of their surface. Thus, the surface of a sound absorber facing the sound field should be as large as possible and should be presented to the sound field as open as possible. Conventional sound absorbers provide good sound reduction above 2000 Hz. However, the frequency range of the sound absorption cannot be adjusted easily.

Resonator chambers may be combined with sound absorbers to achieve a lowering of airborne and structure-borne sound across a particularly broad band. A device that uses both principles is disclosed in WO 2019/092038 A1. WO 2019/092038 A1 relates to a sound attenuator that comprises a flow channel with a flow channel wall and a resonator chamber adjacent to the flow channel wall. The flow channel wall is formed in a sound-absorbing manner by a given permeability in the area bordering the resonator chamber. It thus acts as a sound absorber. To enable the air flowing through the flow channel to communicate with the resonator chamber, the flow channel wall also is provided with a plurality of wall apertures.

The known device has proven its worth, but has a disadvantage that the resonator effect can be impaired by the large absorption surface separating the flow channel from the resonator chamber.

A device for noise reduction with a flow channel and a resonator chamber adjacent to the flow channel also is known from the generic class-forming EP 3 594 585 A1, in which the flow channel wall is formed in a sound-absorbing manner in the area bordering the resonator chamber. In addition, the part of the flow channel wall formed from a sound-absorbing foam is covered towards the resonator chamber by an acoustically reflecting inner wall of the resonator chamber. The flow channel wall and the inside wall of the resonator chamber are provided with passable wall apertures to connect the flow channel with the resonator chamber in a fluid dynamically manner.

A disadvantage of this known device is that the resonator chamber and the sound absorber do not work together optimally.

CH 550 964 A discloses a sound attenuator that comprises a flow channel with a flow channel wall and multiple resonator chambers adjacent to the flow channel wall. All walls of the resonator chambers are made of foam, such as polystyrene. The same is true for the inner walls of the resonator chambers facing the flow channel, and these inner walls also form the flow channel wall of the flow channel in the area bordering the resonator chambers. To enable the air flowing through the flow channel to communicate with the resonator chambers, the inner walls of the resonator chambers are provided with a plurality of wall apertures. In addition, sound-absorbing mineral wool, which is held by a mesh screen, is arranged in the flow channel.

A disadvantage of this known device is that the resonator effect is not optimally designed.

DE 10 2014 225 749 A1 discloses a sound attenuator that comprises a flow channel in the form of an exhaust pipe to which a resonator chamber is adjacent. The sound medium—in this case, exhaust gas—enters the resonator chamber via apertures in the wall of the exhaust pipe. The cavity of the resonator chamber may be filled with sound-absorbing material such that the cavity serves as an absorption chamber.

DE 100 58 479 A1 also discloses a sound attenuator in which the resonator chamber is filled with sound-absorbing material. In addition, a layer of fleece is arranged between the perforated wall of the flow channel and the absorption material. The layer of fleece prevents the absorption material from entering the flow channel.

DE 10 2018 201 829 A1 discloses an electromotive refrigerant compressor with a sound attenuator to reduce sound propagation in the compressed refrigerant. The sound attenuator has a deflector surface where the compressed refrigerant is deflected after impact. Part of the energy of the sound is absorbed by the deflector surface and converted into heat, while another part of the sound is scattered back, which has the effect that the sound is attenuated overall. The deflector surface is roughened to enhance the sound-absorbing effect.

A disadvantage of all known devices is that the sound reduction is not optimal.

It is an object of the present invention to improve the known devices for reducing airborne and structure-borne sound in such a manner that the sound absorption is improved without impairing the resonator effect.

SUMMARY

The above-described object is achieved by providing a sound absorber with openings. The sound absorber with openings completely covers the wall aperture of the inner wall of the resonator chamber so that sound waves flowing through the flow channel must necessarily pass the sound absorber to enter the at least one resonator chamber.

The invention provides an acoustically reflecting wall between the sound absorber and the volume of the resonator chamber, and this wall is in contact with the sound absorber. The term “acoustically reflecting” is used in the sense of "with high (sound) wave resistance", i.e. essentially impermeable to sound, strongly reflecting the sound. The acoustically reflecting wall has a window or aperture that allows sound waves to pass through into the resonator chamber. An acoustically reflecting layer between the sound absorber and the volume of the resonator chamber reduces the face of the sound absorber facing the inside of the resonator chamber, as compared to the device known from WO 2019/092038 A1. In this way, the resonance effect of the resonator chamber is increased and greater noise reduction is achieved. An optimal resonance effect may be achieved if all walls of the resonance chamber are made of an acoustically reflecting material. Better sound absorption may be achieved by arranging the sound absorber in front of the resonator chamber in the direction of flow of the sound waves.

In general, the size of the absorber face, and thus the sound absorbing effect, can be selected independently of the size and volume of the resonator chamber. In any case, however, the face of the sound absorber in the area bordering the resonator chamber is at least as large as the face of the at least one wall aperture. This ensures that the sound absorber completely covers the wall aperture of the inner wall of the resonator chamber and that sound waves flowing through the flow channel must pass the sound absorber to enter the at least one resonator chamber.

In some embodiments, the face of the sound absorber in the area bordering the resonator chamber is larger than the face of the at least one wall aperture. Thus, the sound absorber that projects beyond the edges of the at least one wall aperture can be attached to the adjacent acoustically reflecting inner wall of the resonator chamber.

To absorb the sound in the best possible way, the face of the sound absorber in the area bordering the resonator chamber is advantageously at least twice as large as the face of the at least one wall aperture.

It may be advantageous if the face of the sound absorber in the area bordering the resonator chamber is at least three times as large as the face of the at least one wall aperture.

In some embodiments, the inner wall of the resonator chamber has exactly one wall aperture. However, the inner wall of the resonator chamber may have multiple wall apertures. The outline of the wall apertures is irrelevant. The decisive factor is that the face of at least one wall aperture is larger than the face of one of the openings of the sound absorber. Otherwise the at least one wall aperture of the inner wall of the resonator chamber would no longer be covered by the sound absorber.

The sound absorber of some embodiments is formed from foam. In principle, it is possible to form the sound absorber as having one or more layers. Due to their porosity, certain foams have high transmission and dissipation coefficients as well as low reflection coefficients and thus absorb sound very well. Moreover, foam has a low dead weight. Sound absorbers made of foam are particularly suitable for use with gaseous media, especially air. Alternatively, the sound absorber may be formed from fleece or another porous or fibrous material.

The surface of the sound absorber may be roughened to increase the flow resistance of the sound absorber.

The sound absorber may be covered with a fleece towards the flow channel. This reduces turbulent flows that can occur on the surface of the sound absorber and thus reduces noise.

Optionally, the resonator chamber can have at least one guide web starting from the outer wall of the resonator chamber facing away from the flow channel, said guide web being spaced apart from the inner wall of the resonator chamber and running parallel to the end walls of the resonator chamber. If multiple guide webs are provided, they may be of different lengths. The arrangement of one or more guide webs enables a controlled pressure-resonance build-up of the resonator chamber. This further increases the possibilities of influencing the sound reduction at different frequencies. While the individual resonator chambers are used in particular to set fundamental frequencies, the guide webs are used in particular to set frequencies of a higher order.

In some embodiments, the inner wall of the resonator chamber and the outer wall of the resonator chamber are formed as pipe sections running concentrically to one another. The connection between the inner wall and the outer wall of the resonator chamber is made in a known manner via the end walls of the resonator chamber or resonator chambers. Such designs are suitable, for example, for reducing airborne and structure-borne sound in connection with turbochargers.

Alternatively, the flow channel wall may be concave in its longitudinal direction at least in the area bordering the resonator chamber and may form an open channel. Such a design is particularly suitable for fan resonators in connection with air conditioning systems.

Further details and advantages of the invention can be seen in the following description and drawings.

DETAILED DESCRIPTION

Identical reference numbers in the Figures indicate identical or analogous elements.

Figure 1:
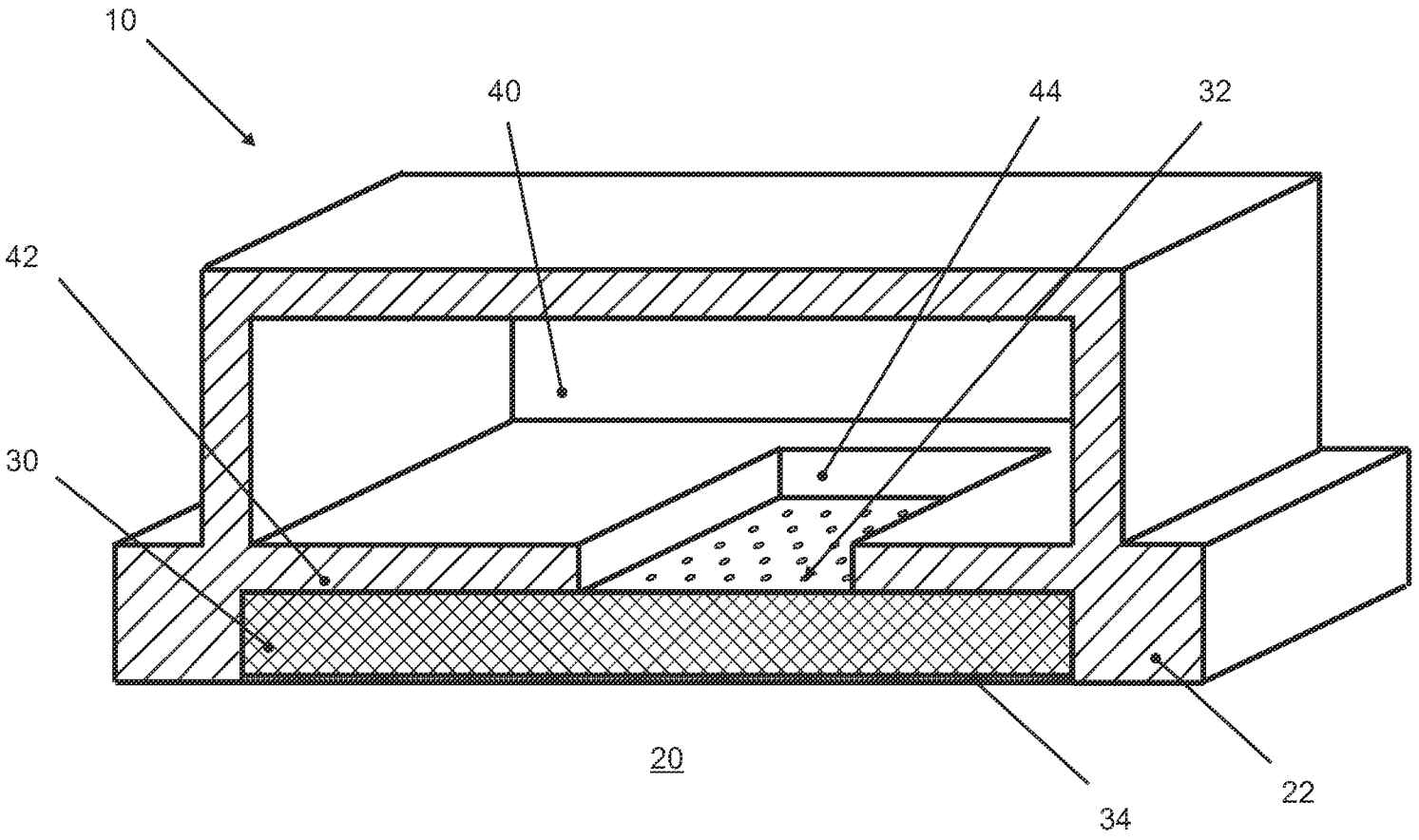
FIG. 1 is a conceptual sectional representation of a device for reducing airborne and structure-borne sound according to the invention.

FIG. 1 shows a sectional view of a device according to the invention for reducing airborne and structure-borne sound 10. The device comprises a flow channel 20 with a flow channel wall 22 and a resonator chamber 40 adjacent to the flow channel wall 22. In the example shown, the flow channel wall 22 is formed in the entire area bordering the resonator chamber 40 by a sound absorber 30 with openings 32. However, the face of the sound absorber 30 may also protrude beyond the area bordering the resonator chamber 40, or only make up part of the bordering area. Towards the resonator chamber 40, the sound absorber 30 is covered by an acoustically reflecting inner wall 42 of the resonator chamber with a wall aperture 44.

Figure 2:
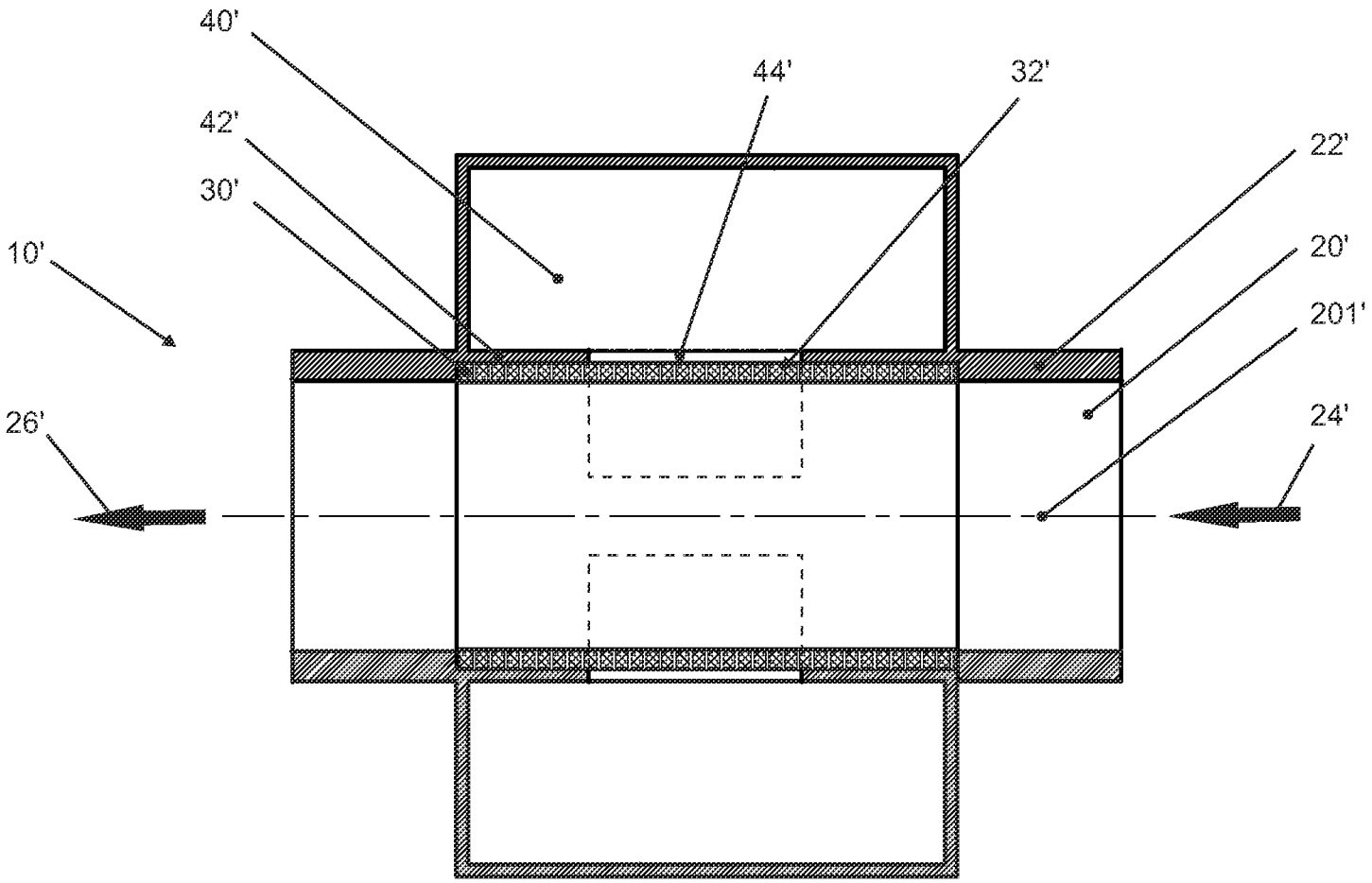
FIG. 2 is a sectional side view of a device for reducing airborne and structure-borne sound according to the invention.

FIG. 2 shows a sectional side view of a device for reducing airborne and structure-borne sound 10' according to the invention. The device comprises a flow channel 20' which, starting from its longitudinal center line 201', is bounded in radial direction by a flow channel wall 22'. The flow channel 20' has an inlet 24' and an outlet 26' through which sound waves can enter and exit the flow channel 20'. A resonator chamber 40' which is adjacent to the flow channel wall 22' is arranged between the inlet 24' and the outlet 26'. The flow channel wall 22' is formed in the area bordering the resonator chamber 40' from a sound absorber 30' provided with openings 32'. Towards the resonator chamber 40', the sound absorber 30' is covered by an acoustically reflecting inner wall 42' of the resonator chamber, which comprises a wall aperture 44'. In the embodiment example shown, the inner wall 42' of the resonator chamber only has one wall aperture 44'. However, it may also have multiple wall apertures 44'. Furthermore, in the embodiment example of FIG. 1, the face of the sound absorber 30' in the area bordering the resonator chamber 40' is larger than the face of the wall aperture 44'. However, it may be sufficient if both faces are approximately the same size. Preferably, the face of the sound absorber 30' in the area bordering the resonator chamber 40' is at least twice as large as the face of the wall aperture 44'. It may also be three times as large as the face of the wall aperture 44' or even larger still. Preferably, the sound absorber 30' is formed from a foam that is roughened on its surface. For a particularly good reduction of turbulent flow, the sound absorber 30' may be covered with a fleece (not shown here) towards the flow channel 20'. Furthermore, the resonator chamber may have one or more guide webs (not shown here).

Figure 3:
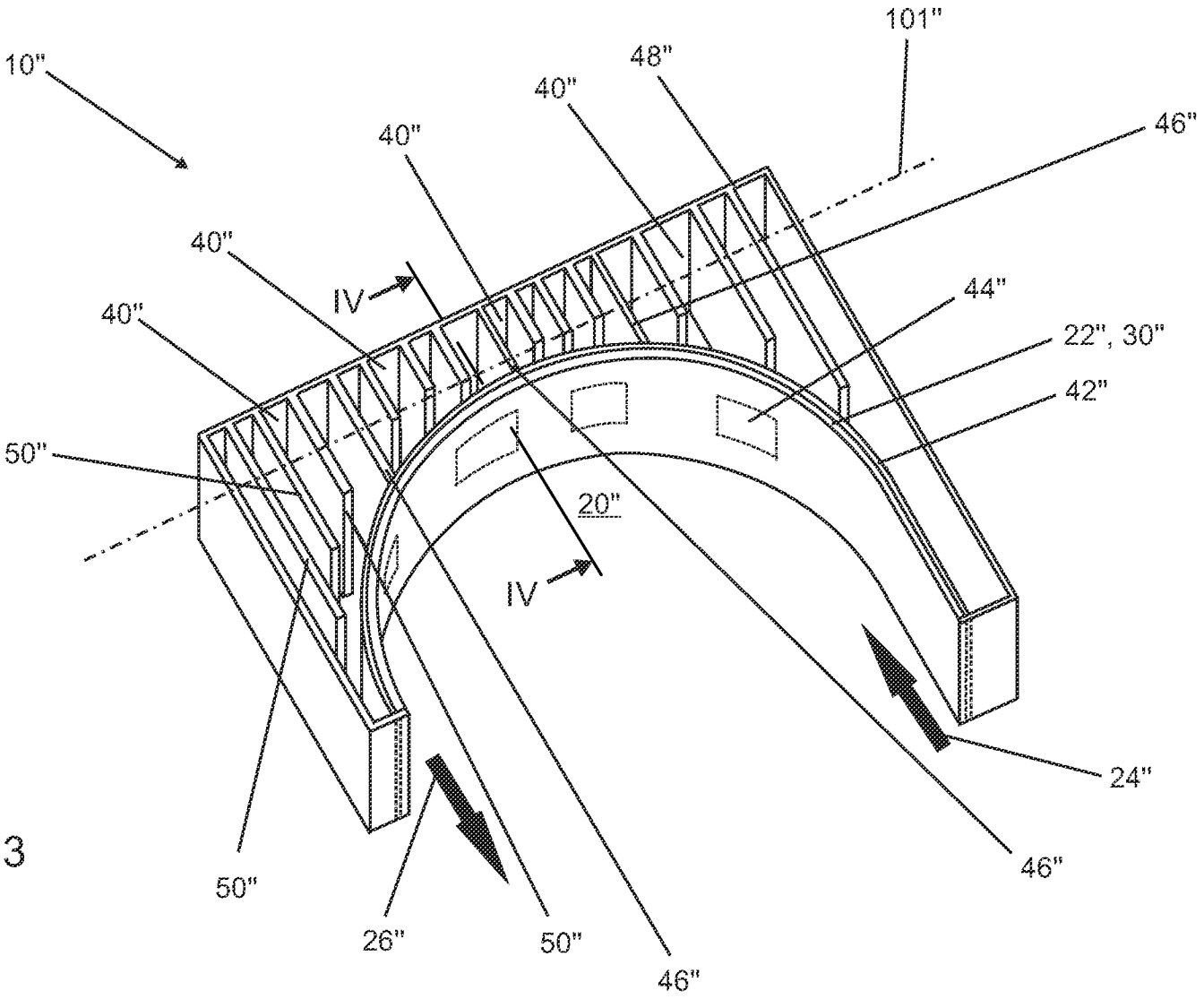
FIG. 3 is a spatial representation of another device for reducing airborne and structure-borne sound according to the invention, cut along lines III-III of FIG. 4.
Figure 4:
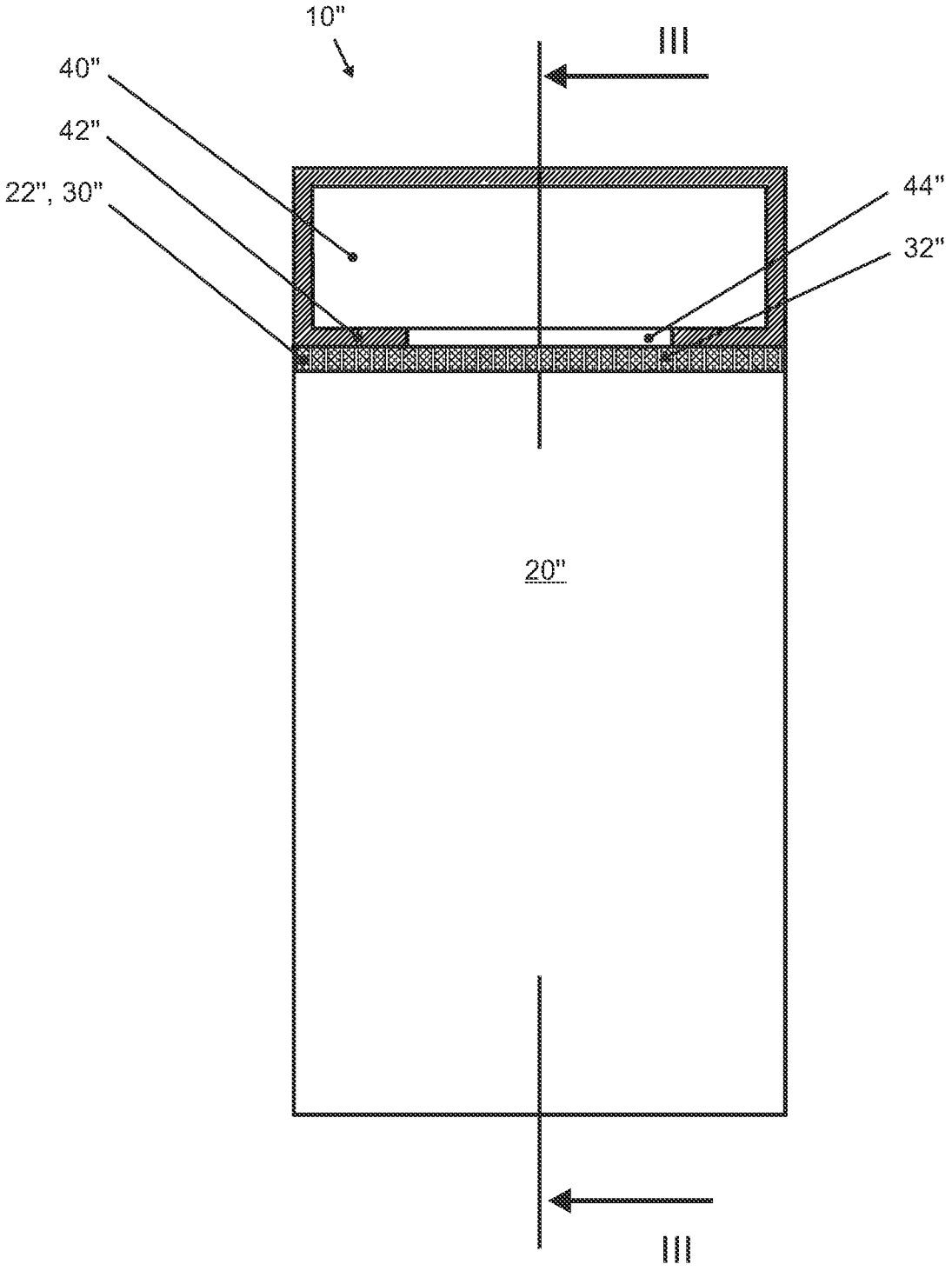
FIG. 4 is a view of the embodiment of FIG. 3, cut along line IV-IV.

FIG. 3 shows a further embodiment of a device for reducing airborne and structure-borne sound 10" according to the invention, in which four resonator chambers 40" are arranged in series one behind the other in the flow direction of the sound waves between an inlet 24" and an outlet 26" of a flow channel 20". The volumes of the resonator chambers 40" are separated by end walls 46". The resonator chambers 40" may have guide webs 50" which start from the outer wall 48" of the resonator chamber facing away from the flow channel 20", are spaced apart from the inner wall 42" of the resonator chamber and run parallel to the end walls 46" of the resonator chambers 40". According to the embodiment example in FIG. 3, the individual resonator chambers 40" have guide webs 50" of different lengths. However, the guide webs 50" may also be of the same length. As can be seen in FIG. 4, which shows a view of the embodiment of FIG. 3 cut along line IV-IV, the resonator chambers 40" have a rectangular cross-section transverse to the longitudinal direction 101" of the device for reducing airborne and structure-borne sound 10". The outer wall of the resonator chamber 48" runs parallel to the longitudinal direction 101", while in the embodiment example of FIGS. 3 and 4 the flow channel wall 22" is formed concavely in its longitudinal direction at least in the area bordering the resonator chamber 40" and forms an open channel.

Of course, the embodiments discussed in the special description and shown in the Figures are only illustrative embodiment examples of the present invention. This disclosure provides the person skilled in the art with a wide range of possible variations.

What is claimed is:

1. A device for reducing airborne and structure-borne sound (10, 10', 10"), comprising a flow channel (20, 20', 20") with a flow channel wall (22, 22', 22") and at least one resonator chamber (40, 40', 40") adjacent to the flow channel wall (22, 22', 22"), the flow channel wall (22, 22', 22") being formed by a sound absorber (30, 30', 30") at least in a part of the area bordering the resonator chamber (40, 40', 40"), wherein the sound absorber (30, 30', 30") is covered towards the resonator chamber (40, 40', 40") by an acoustically reflecting inner wall (42, 42', 42") of the resonator chamber with at least one window (44, 44', 44") extending from the flow channel (20, 20', 20") to the at least one resonator chamber (40, 40', 40"), wherein the sound absorber (30, 30', 30") is formed from a porous or fibrous material and is provided with straight openings (32, 32', 32") extending through the sound absorber (30, 30', 30") from the flow channel (20, 20', 20") to the at least one resonator chamber (40, 40', 40"), and the sound absorber (30, 30', 30") that is provided with the straight openings (32, 32', 32") completely covers the window (44, 44', 44") of the inner wall (42, 42', 42") of the resonator chamber such that sound waves flowing through the flow channel (20, 20', 20") must pass the sound absorber (30, 30', 30") to enter the at least one resonator chamber (40, 40', 40").

2. The device of claim 1, wherein the inner wall of the resonator chamber (42, 42') has exactly one window (44, 44').

3. The device of claim 1, wherein the sound absorber (30, 30', 30") covers an area of the flow channel wall (22, 22', 22") that is larger than an area defined by the at least one window (44, 44', 44").

4. The device of claim 1, wherein the sound absorber (30, 30', 30") covers an area of the flow channel wall (22, 22', 22") that is at least twice as large as an area defined by the at least one window (44, 44', 44").

5. The device of claim 1, wherein the sound absorber (30, 30', 30") covers an area of the flow channel wall (22, 22', 22") that is at least three times as large as an area defined by the at least one window (44, 44', 44").

6. The device of claim 1, wherein the sound absorber (30, 30', 30") is formed from foam.

7. The device of claim 1, wherein the surface of the sound absorber (30, 30', 30") is roughened.

8. The device of claim 1, wherein the sound absorber (30) is covered with a fleece (34) towards the flow channel (20).

9. The device of claim 1, wherein the flow channel wall (22") is formed concavely in its longitudinal direction (101") at least in the area bordering the resonator chamber (40") and forms an open channel.

10. A device for reducing airborne and structure-borne sound (10, 10', 10"), comprising:

a flow channel wall (22, 22', 22") with an inlet (24'), an outlet (24') and a flow channel (20, 20', 20") extending between the inlet (24') and the outlet (26');

a resonator chamber (40, 40', 40") adjacent to the flow channel wall (22, 22', 22") and external of the flow channel (20, 20', 20") so that a part of the flow channel wall (22, 22', 22") defines an acoustically reflecting inner wall (42, 42', 42") of the resonator chamber (40, 40', 40");

a window (44, 44', 44") formed through the flow channel wall (22, 22', 22") and extending between the flow channel (20, 20', 20") and the at least one resonator chamber (40, 40', 40"); and a sound absorber (30, 30', 30") disposed on a side of the flow channel wall (22, 22', 22") opposite the resonator chamber (40, 40', 40") and completely covering the window (44, 44', 44"), the sound absorber (30, 30', 30") being formed from a porous or fibrous material and being provided with straight openings (32, 32', 32") extending from the flow channel (20, 20', 20") to the resonator chamber (40, 40', 40"), wherein the sound absorber (30, 30', 30") accommodates sound waves flowing between the flow channel (20, 20', 20") and the at least one resonator chamber (40, 40', 40").

11. The device of claim 10, wherein a surface area of the flow channel wall (22, 22', 22") facing into the flow channel (20, 20', 20") includes a recess, the window (44, 44', 44")

being formed through a part of the flow channel wall (22, 22', 22") having the recess, the sound absorber (30, 30', 30") being disposed in the recess.

12. The device of claim 10, wherein an area defined by the sound absorber (30, 30', 30") is larger than an area defined by the window (44, 44', 44").

13. The device of claim 10, wherein the straight openings (32, 32', 32") extending through the sound absorber (30, 30', 30") are aligned transverse to a longitudinal center line (201') of the flow channel (20, 20', 20") extending between the inlet (24') and the outlet (26').

14. The device of claim 10, wherein each of the straight openings (32, 32', 32") defines a cross-sectional area that is smaller than a cross-sectional area of the window (44, 44', 44").

15. The device of claim 10, further comprising a fleece (34) covering a surface of the sound absorber (30) facing towards the flow channel (20).

* * * * *